US007503433B2

(12) United States Patent
Wang

(10) Patent No.: US 7,503,433 B2
(45) Date of Patent: Mar. 17, 2009

(54) ELEVATOR

(76) Inventor: Chiu Nan Wang, No. 50, Alley 97, Lane 354, San Her Rd., Feng Yuan, Taichung Hsien (TW)

( * ) Notice: Subject to any disclaimer, the term of this patent is extended or adjusted under 35 U.S.C. 154(b) by 31 days.

(21) Appl. No.: 10/409,275

(22) Filed: Apr. 7, 2003

(65) Prior Publication Data

US 2004/0195047 A1 Oct. 7, 2004

(51) Int. Cl.
*B66B 5/00* (2006.01)

(52) U.S. Cl. ..... 187/292; 187/254; 187/401

(58) Field of Classification Search ..... 187/250, 187/254, 263, 266, 288, 290, 292, 298, 306, 187/314, 349, 377, 401, 414
See application file for complete search history.

(56) References Cited

U.S. PATENT DOCUMENTS

| | | | | | |
|---|---|---|---|---|---|
| 1,444,614 | A * | 2/1923 | Kimball | 187/288 |
| 1,953,119 | A * | 4/1934 | McCormick | 187/265 |
| 5,020,639 | A * | 6/1991 | Michel | 187/401 |
| 5,027,925 | A * | 7/1991 | Kahkipuro | 187/292 |
| 5,033,586 | A * | 7/1991 | Richards et al. | 187/259 |
| 5,308,938 | A * | 5/1994 | Roberts et al. | 187/393 |
| 5,322,144 | A * | 6/1994 | Skalski et al. | 187/393 |
| 5,680,911 | A * | 10/1997 | Wang | 187/263 |
| 5,749,444 | A * | 5/1998 | Skalski | 187/401 |
| 5,890,565 | A * | 4/1999 | Wang | 187/263 |
| 6,273,216 | B1 * | 8/2001 | Kocher et al. | 187/377 |
| 6,494,295 | B2 * | 12/2002 | Grundmann | 187/292 |
| 6,892,862 | B2 * | 5/2005 | Helmle | 187/306 |
| 6,959,787 | B2 * | 11/2005 | Husmann | 187/292 |

FOREIGN PATENT DOCUMENTS

| | | | |
|---|---|---|---|
| EP | 1028082 | A2 * | 8/2000 |
| EP | 1031528 | A1 * | 8/2000 |
| GB | 2250012 | A * | 5/1992 |
| JP | 03192088 | A * | 8/1991 |
| JP | 11199163 | A * | 7/1999 |
| WO | WO 9711020 | A1 * | 3/1997 |
| WO | WO 0210048 | A2 * | 2/2002 |

* cited by examiner

*Primary Examiner*—James Keenan

(57) ABSTRACT

An elevator having an inner car suspended within an outer car, and which does not require the provision of mechanical room. A drive motor can be provided in one of rear side top, underside, and either side of the car. The invention has the following advantages. The vibration of inner car is reduced within an acceptable level for bringing a degree of comfort to passengers in the inner car while hoisting or lowering. The hoist ropes are prevented from slipping when a load of the car changes suddenly as in a case that many persons steps in or out of the car in a short period of time. An alignment of a bottom of the car with each of a plurality of levels is made possible when the elevator is stopped at each level. A manual escape device is provided for assisting passengers to escape in case of emergency.

5 Claims, 8 Drawing Sheets

ELEVATOR

FIELD OF THE INVENTION

The present invention relates to elevators and more particularly to such an elevator with improved characteristics.

BACKGROUND OF THE INVENTION

Conventionally, a mechanical room is provided in an elevator facility. The mechanical room is typically located either above a topmost position or below a bottommost position in a traveling path of car. However, such arrangement suffered from several disadvantages. For example, a maintenance personnel has to climb to the mechanical room for inspecting or repairing components in the former case. In the latter case, the mechanical room may be flooded. This is particularly true in a rainy season. Moreover, the provision of mechanical room can consume limited space. Hence, a need for improvement exists.

SUMMARY OF THE INVENTION

It is therefore an object of the present invention to provide an elevator without a mechanical room comprising a parallelepiped car including an inner car, an outer car, one or more resilient members between an underside of the inner car and a bottom of the outer car, an actuator on the bottom of the outer car, a stabilizer at the underside of the inner car, the stabilizer being actuated by the actuator for stabilizing the inner car, and a sensor for sensing a shock of the inner car wherein the actuator is activated by the sensor for attracting the stabilizer in response to an irregularity of the car; a drive motor provided in a predetermined position of the car; a drive wheel provided at one side of the drive motor; a first brake provided at an end of the drive motor; a backup battery below the drive motor; a drive sheave assembly including a sheave and a second brake; a counterweight; a pulley above the counterweight; and hoist ropes having one ends connected to a top position in a traveling path of the car and the other ends connected to another top position in the traveling path of the car by passing the drive wheel, the drive sheave assembly, and the pulley. By utilizing the elevator, the vibration of the inner car is reduced within an acceptable level for bringing a degree of comfort to passenger(s) in the inner car while hoisting or lowering. Also, it is possible of preventing the hoist ropes from slipping when a load of the car changes suddenly as in a case that many persons steps in or out of the car in a short period of time. Moreover, an alignment of a bottom of the car with each of a plurality of levels is made possible when the elevator is stopped at each level.

In one aspect of the present invention, the elevator further comprises a transparent window on a wall of the inner car opposite the drive motor at an outer wall of the outer car, an electromagnetic clutch at an inner wall of the outer car aligned with the drive motor, and a manual wheel at one end of the electromagnetic clutch wherein the manual wheel is operable to activate the electromagnetic clutch for moving the hoist ropes by means of the drive wheel being rotated and the backup battery is discharged to deactivate the first and the second brakes. As such, a passenger can manually hoist or lower the car for escape in case of emergency.

In another aspect of the present invention, the drive motor is a synchronous motor.

In still another aspect of the present invention, the actuator is a magnetic device.

In yet another aspect of the present invention, the predetermined position of the drive motor is at a rear side of the car.

In yet another aspect of the present invention, the predetermined position of the drive motor is at a top of the car.

In a further aspect of the present invention, the predetermined position of the drive motor is at an underside of the car.

In still further aspect of the present invention, the predetermined position of the drive motor is at either side of the car.

The above and other objects, features and advantages of the present invention will become apparent from the following detailed description taken with the accompanying drawings.

DETAILED DESCRIPTION OF THE PREFERRED EMBODIMENTS

Figure 1:
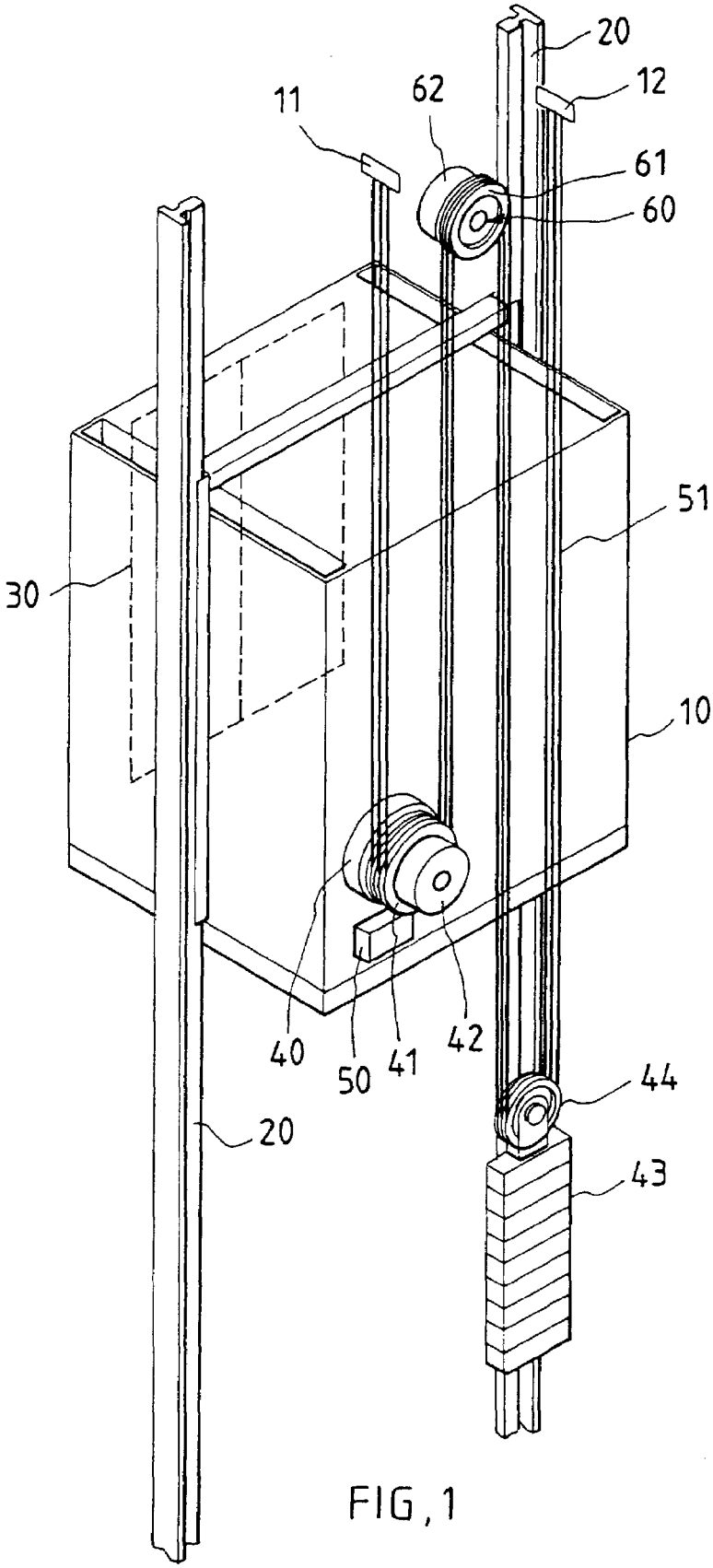
FIG. 1 is a perspective view schematically showing a first preferred embodiment of elevator according to the invention.
Figure 2:
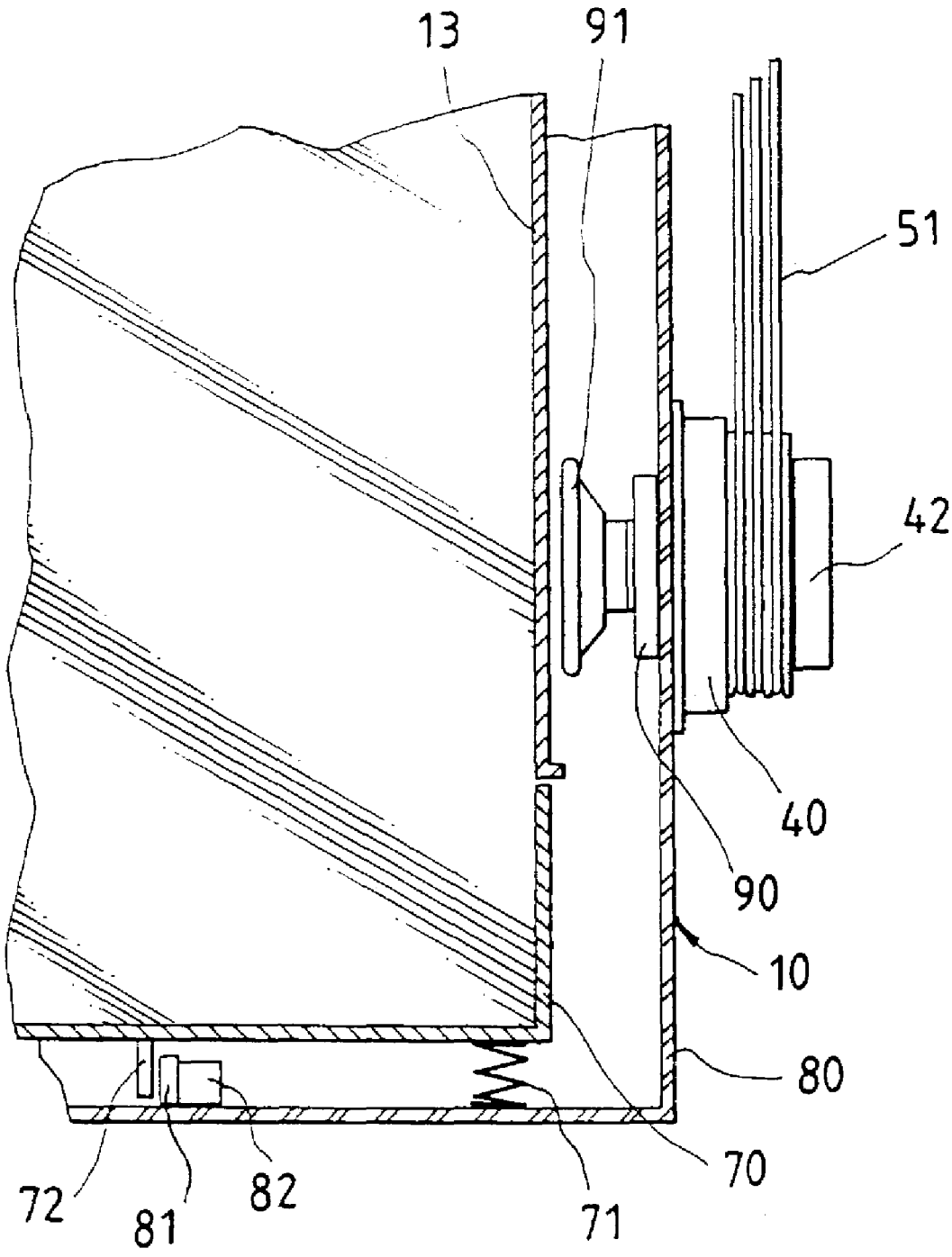
FIG. 2 is a cross-sectional view of a partial car and other associated components such as drive motor, etc.

Referring to FIGS. 1 and 2, there is shown an elevator constructed in accordance with a first Preferred embodiment of the invention. The elevator comprises a parallelepiped car 10 within a support frame 24, slidingly moveable along two parallel vertical guide rails 20, a drive motor 40 provided in a rear side of the car 10 (in this embodiment), the drive motor 40 being implemented as a synchronous motor, a drive wheel 41 formed at one side of the drive motor 40, the drive wheel 41 being rotated when the drive motor 40 is activated, and a first brake 42 formed at an end of the drive motor 40. The provision of the drive motor 40, the drive wheel 41, and the first brake 42 occupies a minimum space and is adapted to install in the rear side Of the car (as in this embodiment) or one of top, underside, and either side thereof. Moreover, only a manhole is required on a wall of the car 10 for inspection or repairs. The car 10 further comprises a backup battery 50 below the drive motor 40 and hoist ropes 51 having one ends connected to a top position 11 in a traveling path of the car 10 and the other ends connected to another top position 12 in the traveling path of the car 10 by passing the drive wheel 41, a drive sheave assembly 60, and a pulley 44 above a counterweight 43. With this configuration, the car 10 can hoist or lower as the drive wheel 41 rotates in response to an activation of the drive motor 40. Also, the provision of the drive sheave assembly 60 having a sheave 61 and a second brake 62 can prevent the hoist ropes 51 from slipping (i.e., the hoist ropes 51 caught by the second brake 62) when a load of the car 10 changes suddenly as in a case that many persons steps in or out of the car 10 in a short period of time. Further, an alignment of a bottom of the car 10 with each of a plurality of levels is made possible when the elevator is stopped at each level.

Moreover, the second brake 62 of the drive sheave assembly 60 can be used as a backup brake in case of a malfunction of the first brake 42.

referring to FIG. 2 specifically, the car 10 consists of an inner car 70 and an outer car 80. One or more resilient members (e.g., springs) 71 are provided between an underside of the inner car 70 and bottom of the outer car 80. An actuator 81 is provided on the bottom of the outer car 80. A stabilizer 72 is provided at the underside of the inner car 70. The stabilizer 72 is actuated by the actuator 81 for stabilizing the inner car 70. A sensor 82 is provided for sensing a shock of the inner car 70. The actuator 81 is activated when the guide rails 20 are uneven or load in the inner car 70 are unbalanced. In the embodiment, the actuator 81 is a magnetic device which is activated by the sensor 82 for example when a kid jumps in the inner car 70, for attracting the stabilizer 72. As a result, the vibration of the inner car 70 is reduced within an acceptable level for bringing a degree of comfort to passenger(s) in the inner car 70 while hoisting or lowering. Also, a walking in or out of the car 10 by passenger(s) will not trigger the sensor 82.

A transparent window 13 is provided on a wall of the inner car 70 opposite the drive motor 40 at an outer wall of the outer car 80. An electromagnetic clutch 90 is provided at an inner wall of the outer car 80 aligned with the drive motor 40. A manual Wheel 91 is provided at one end of the electromagnetic clutch 90. In case of malfunction of the car 10, the window provides access so that a passenger can turn the manual Wheel 91 to activate the electromagnetic clutch 90 for moving the hoist ropes 51 by means of the drive wheel 41 being rotated. Also, the backup battery 50 is deactivated to release the first and second brakes 42 and 62. As a result, the passenger can manually hoist or lower the car 10 for escape in case of emergency.

Figure 3:
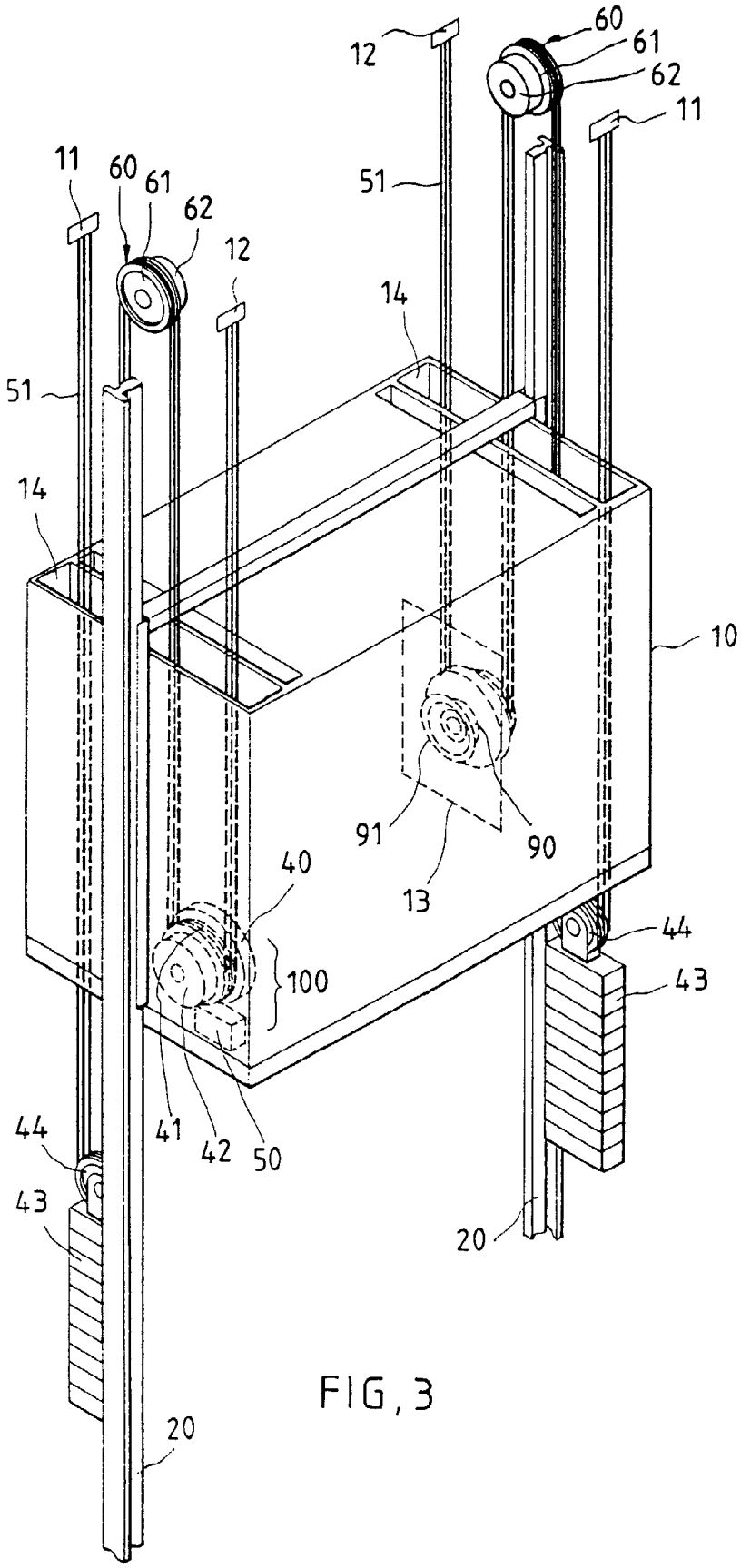
FIG. 3 is a perspective view schematically showing a second preferred embodiment of elevator according to the invention.

Referring to FIG. 3, there is shown an elevator constructed in accordance with a second preferred embodiment of the invention. The characteristics of the second preferred embodiment are detailed below. The configuration of this embodiment is adapted to a large elevator. In detail, two drive motor assemblies 100 are provided at opposite sides of the car 10 and are substantially diagonal. A longitudinal channel 14 is provided at either side of the car 10 for accommodating the drive motor assembly 100. Other components of the elevator and operation thereof are substantially the same as the first embodiment. Thus a detailed description thereof is omitted herein for the sake of brevity.

Figure 4:
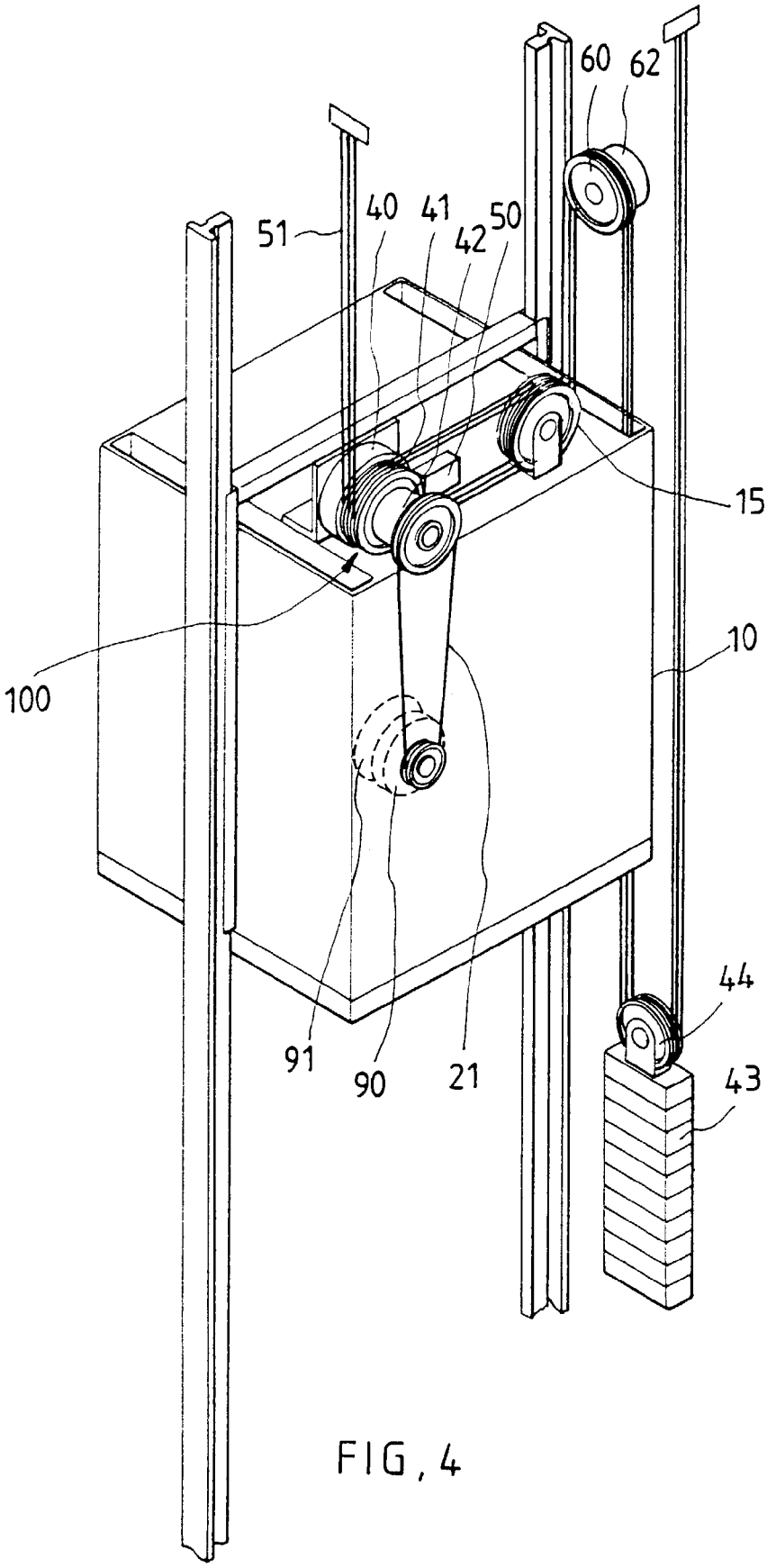
FIG. 4 is a perspective view schematically showing a third preferred embodiment of elevator according to the invention.

Referring to FIG. 4, there is shown an elevator constructed in accordance with a third preferred embodiment of the invention. The characteristics of the third preferred embodiment are detailed below. A drive motor assembly 100 is provided on top of the car 10. The backup battery 50 is provided adjacent the drive motor assembly 100. A driven wheel 15 is also provided on top of the car 10. The hoist ropes 51 have both ends connected to top positions in the traveling path of the car 10 by passing the drive wheel 41 of the drive motor 40, the driven wheel 15, the drive sheave assembly 60, and the pulley 44 above the counterweight 43. The electromagnetic clutch 90 is connected to the drive motor assembly 100 by means of a chain. Other components of the elevator and operation thereof are substantially the same as the first embodiment. Thus a detailed description thereof is omitted herein for the sake of brevity.

Figure 5:
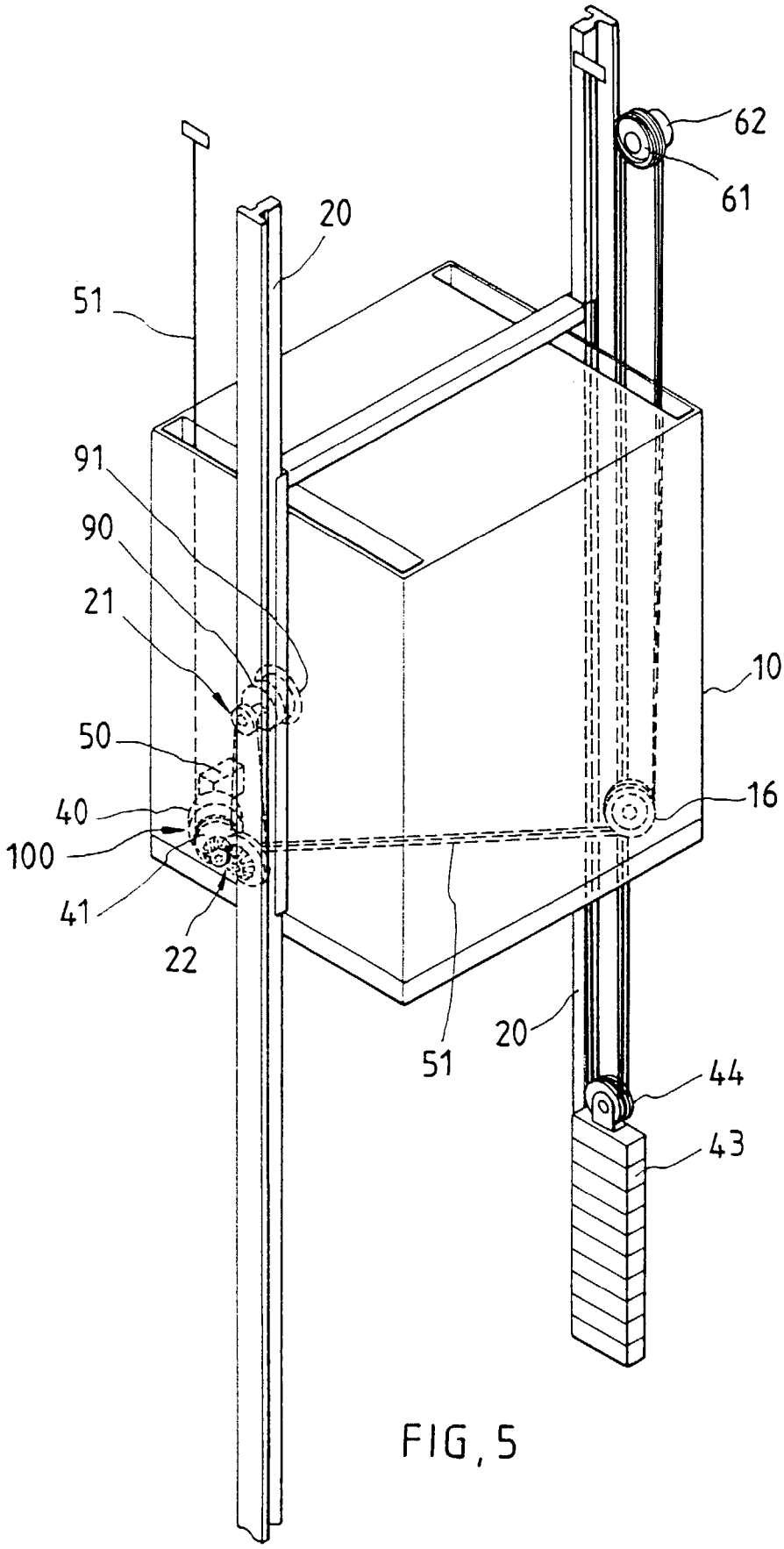
FIG. 5 is a perspective view schematically showing a fourth preferred embodiment of elevator according to the invention.
Figure 6:
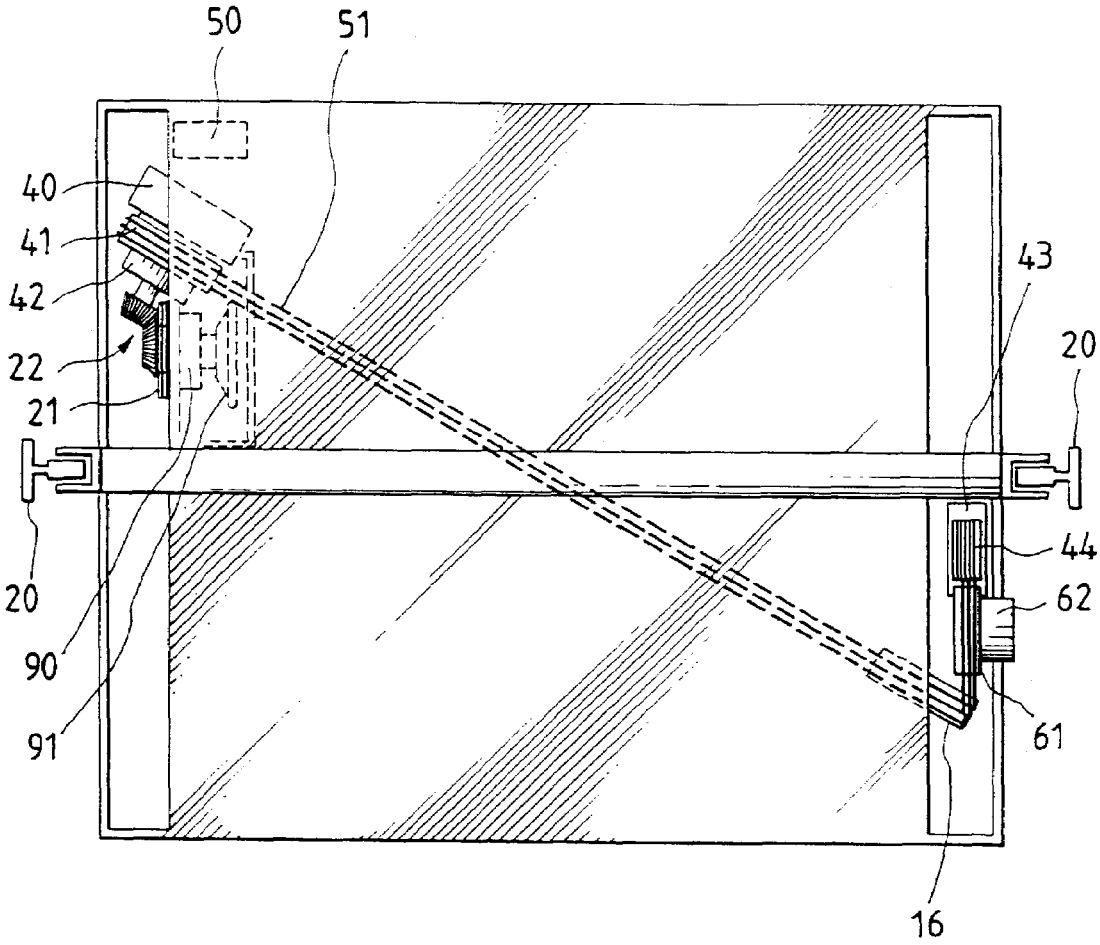
FIG. 6 is a schematic top plan view of the elevator shown in FIG. 5.

Referring to FIGS. 5 and 6, there is shown an elevator constructed in accordance with a fourth preferred embodiment of the invention. The characteristics of the fourth preferred embodiment are detailed below. A drive motor assembly 100 is disposed under a bottom corner of the car 10. The backup battery 50 is provided adjacent the drive motor assembly 100. The hoist ropes 51 have both ends connected to top positions in the traveling path of the car 10 by passing the drive wheel 41 of the drive motor 40, the driven wheel 16 at the diagonal corner relative to the drive motor assembly 100, the drive sheave assembly 60, and the pulley 44 above the counterweight 43. Other components of the elevator and operation thereof are substantially the same as the first embodiment. Thus a detailed description thereof is omitted herein for the sake of brevity.

Figure 7:
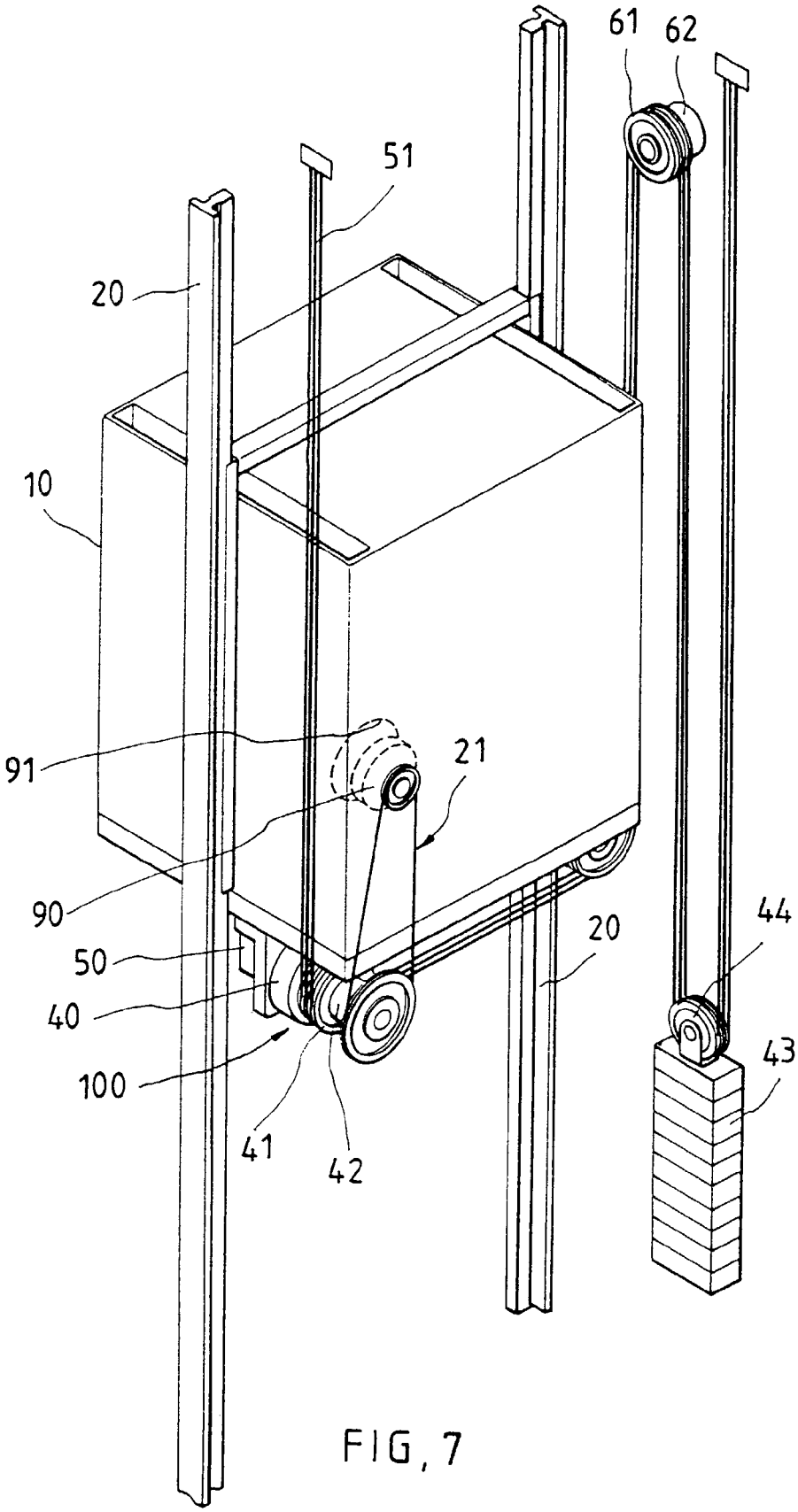
FIG. 7 is a perspective view schematically showing a fifth preferred embodiment of elevator according to the invention.
Figure 8:
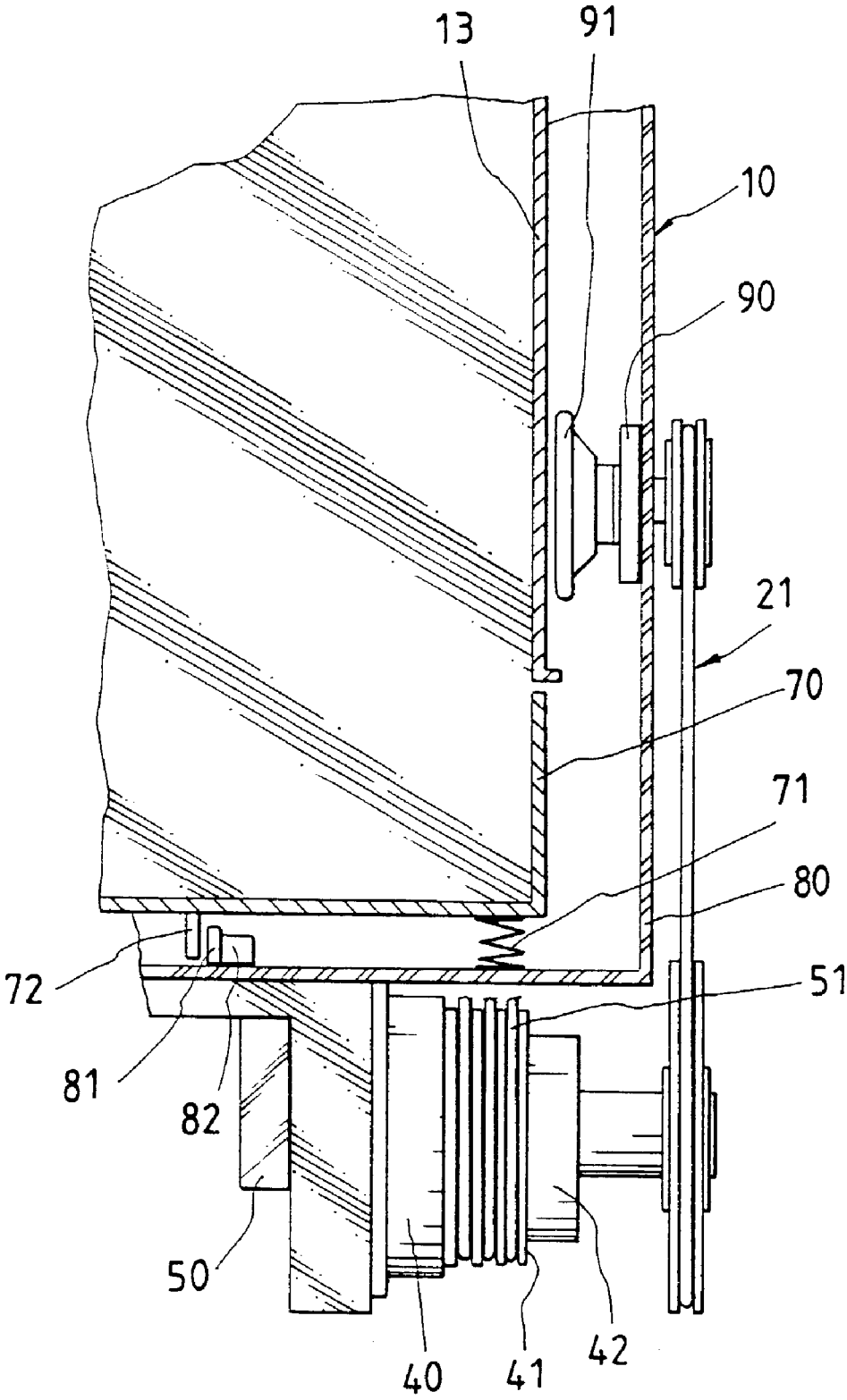
FIG. 8 is a cross-sectional view of a partial car and other associated components of the FIG. 7 elevator.

Referring to FIGS. 7 and 8, there is shown an elevator constructed in accordance with a fifth preferred embodiment of the invention. The characteristics of the fifth preferred embodiment are detailed below. A drive motor assembly 100 is provided at a bottom side of the car 10. The backup battery 50 is provided adjacent the drive motor assembly 100. The hoist ropes 51 have both ends connected to top positions in the traveling path of the car 10 by passing the drive wheel 41 of the drive motor 40, the driven wheel (not shown), the drive sheave assembly 60, and the pulley 44 above the counterweight 43. Other components of the elevator and operation thereof are substantially the same as the first embodiment. Thus a detailed description thereof is omitted herein for the sake of brevity.

While the invention has been described by means of specific embodiments, numerous modifications and variations could be made thereto by those skilled in the art without departing from the scope and spirit of the invention set forth in the claims.

What is claimed is:

1. An elevator comprising:

a parallelepiped car having a support frame, an outer car attached within the support frame, an inner car, interior of and suspended from the outer cart, a vertically resilient suspension system resiliently supporting the inner car from a floor of the outer car, the suspension system further comprising one or more resilient members between an underside of the inner car and the floor of the outer car, an actuator on the floor of the outer car, a stabilizer at the underside of the inner car, the stabilizer being actuated by the actuator for stabilizing the inner car, and a sensor for sensing a shock of the inner car wherein the actuator is activated by the sensor for attracting the stabilizer in response to an irregularity of the car;

a drive system attached to the outer car, further comprising a drive motor in a predetermined position of the car, a drive wheel at one side of the drive motor, a first brake at an end of the drive motor, a backup battery below the drive motor, a drive sheave assembly including a sheave and a second brake;

a counterweight with a pulley above the counterweight; and a plurality of hoist ropes each having a first end connected to a first top position in a traveling path of the car and a second end connected to a second top position in the traveling path of the car by passing the drive wheel, the drive sheave assembly, and the pulley.

2. The elevator of claim 1, wherein the drive motor is a synchronous motor.

3. The elevator of claim 1, wherein the actuator is a magnetic device.

4. The elevator of claim 1, further comprising a transparent window on a wall of the inner car opposite the drive motor at an outer wall of the outer car, an electromagnetic clutch at an inner wall of the outer car aligned with the drive motor, and a manual wheel at one end of the electromagnetic clutch wherein the manual wheel is operable to activate the electromagnetic clutch for moving the hoist ropes by means of the drive wheel being rotated after the backup battery is deactivated to release the first and the second brakes.

5. The elevator of claim 1, wherein the predetermined position of the drive motor is at a rear side of the car.

* * * * *